United States Patent [19]

Clymer

[11] Patent Number: 4,494,662

[45] Date of Patent: Jan. 22, 1985

[54] MOUNTED SPRING DEVICE FOR RESISTING FLEXING

[76] Inventor: Ronald S. Clymer, 1914A W. Pratt Blvd., Chicago, Ill. 60626

[21] Appl. No.: 472,011

[22] Filed: Mar. 4, 1983

[51] Int. Cl.[3] ..... A63B 21/00

[52] U.S. Cl. ..... 272/134; 272/136; 272/143

[58] Field of Search ..... 272/138, 146, 144, 93, 272/109, 134, 136, 140

[56] References Cited

U.S. PATENT DOCUMENTS

| | | | |
|---|---|---|---|
| 2,022,002 | 11/1935 | Jacks | 272/137 |
| 2,351,293 | 6/1944 | Saunders | 272/146 |
| 3,802,701 | 4/1974 | Good | 272/138 X |
| 4,063,727 | 12/1977 | Hall | 272/136 |

*Primary Examiner*—Richard J. Apley
*Assistant Examiner*—William R. Browne
*Attorney, Agent, or Firm*—Hill, Van Santen, Steadman & Simpson

[57] ABSTRACT

An exercise device includes a spring mounted handle carried on a base. The base may be carried by a support platform which also supports the user, may be releasably connected to the platform, may be hinged at the platform, or may be secured to a wall. A spring which mounts the handle to the base is an elongate spring and the handle is T-shaped so that a user may manipulate the handle in a plane generally parallel to the base or in a plurality of planes extending through the point of attachment of the spring to the base, the spring constituting an energy storing device which stores energy upon the application of force and releases that energy upon removal of such force.

8 Claims, 4 Drawing Figures

MOUNTED SPRING DEVICE FOR RESISTING FLEXING

BACKGROUND OF THE INVENTION

1. Field of the Invention

The present invention relates to exercise machines, and is more particularly concerned with an exercise device which essentially has no moving parts in which friction is involved, such as rollers, articulated or compound levers, ropes or the like.

2. Description of the Prior Art

Many exercise machines are known in the art which involve the use of ropes and pulleys, compound levers, weights and the like for body building and exercise purposes. All of these devices require movement of one part against and relative to another part as manifest in bearings, pivots, cable runs etc.

SUMMARY OF THE INVENTION

It is the primary object of the present invention to provide an exercise machine which requires no relative movement, in the sense of friction, between the parts thereof, which is compact, economical, easy to use and takes up a relatively small space.

The above object is achieved, according to the invention, by the provision of a base which is adapted for attachment to a support, for example a floor or a wall, and a manipulation structure extending from the base which includes a handle connected to an energy storage device, such as a spring, which is in turn connected to the base. The energy storage device resists movement of the handle and restores the same to a rest position upon the removal of force therefrom.

More specifically, the handle may be a T-shaped handle which is telescopically received in and adjustably fixed to a tube carried by the upper end of the spring so as to adapt the device to a height which is comfortable for the user.

The spring may be covered with a vinyl or rubber boot, for aesthetic reasons and the entire base and spring structure may be hinged and releasably latched to the support for folding and storage, in addition to the handle being removable for storage.

According to a particular feature of the invention, the support may constitute a platform carried by the floor, the platform having an area on which the user is to stand. A section of the platform may be mounted for back and forth rotary movement and spring-biased to resist the movement of the feet of the user and to return to a normal rest position.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Inasmuch as a plurality of embodiments are illustrated together in a composite form, each will be treated separately below.

Fixed Mat Platform

Figure 1:
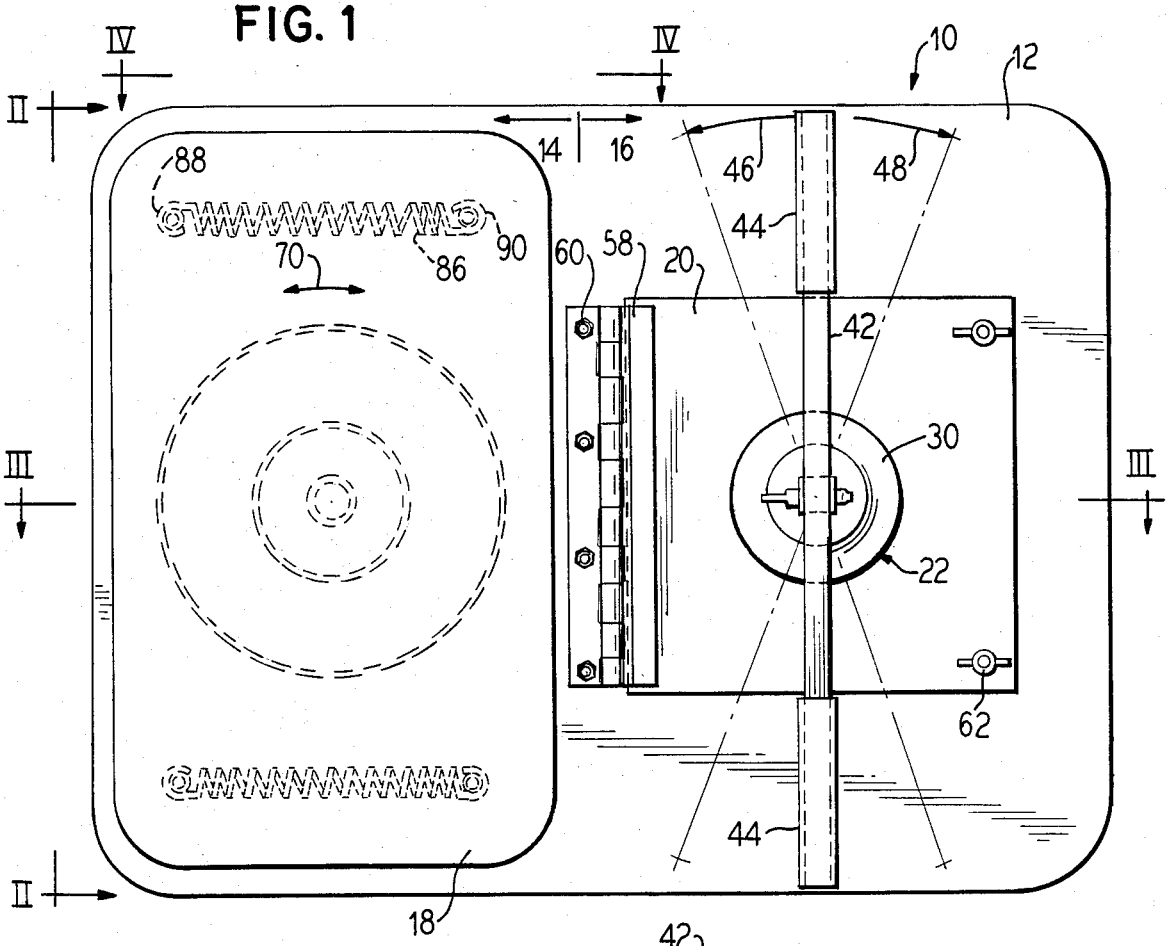
FIG. 1 is a top view of an exercise device constructed in accordance with the invention.
Figure 3:
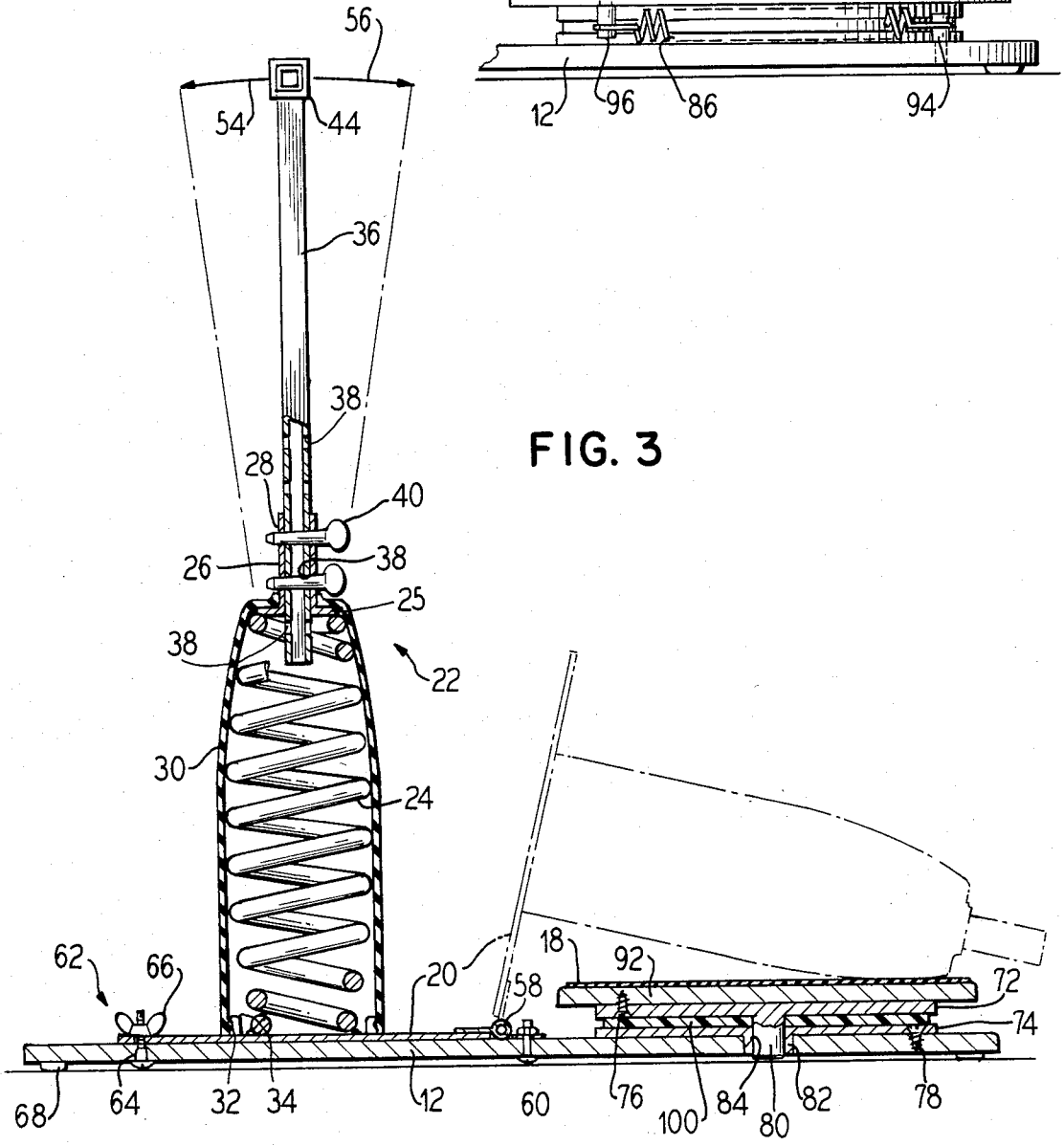
FIG. 3 is a sectional view taken substantially along the line III—III of FIG. 1.

Referring to FIGS. 1 and 3, an exercise device is generally illustrated at 10 as comprising a platform 12 which is divided into two sections 14 and 16.

The section 14 fixedly mounts a rubber mat 18 for supporting and providing traction for the feet of a user.

The section 16 supports the manipulative portion of the exercise device. The section 16 carries a base 20 secured to the platform 12 and supporting a handle structure 22 which comprises an elongate coil spring 24 which has its lower end secured to the base 20, as by welding. The upper end of the spring 24 has an apertured plate 25 secured thereto, also as by welding. The plate 25 has a tube 26 welded thereto so as to provide a passageway into the central portion of the spring. The tube 26 includes a plurality of spaced apertures 28 for receiving adjusting pins 40 as will be discussed below.

Primarily for aesthetic reasons, a boot 30 surrounds the spring 24 and embraces the tube 26. At the lower end, the boot 30 surrounds a ring 34 which is affixed to the base 20, again by welding, and is releasably secured thereto by a plurality of fasteners 32, such as snaps for heavy clothing, in which one part of the snap is secured to the ring 34 and the other part of the snap is secured to the boot 30.

A vertical handle 36 is telescopically received through the tube 26 and is provided with a plurality of holes 38, spaced equally to the holes 28 of the tube 26, for also receiving the tapered pins 40. This structure provides for adjustment of the handle 36 with respect to the platform so that an upper cross member 42 is comfortably positioned with respect to the user.

Figure 2:
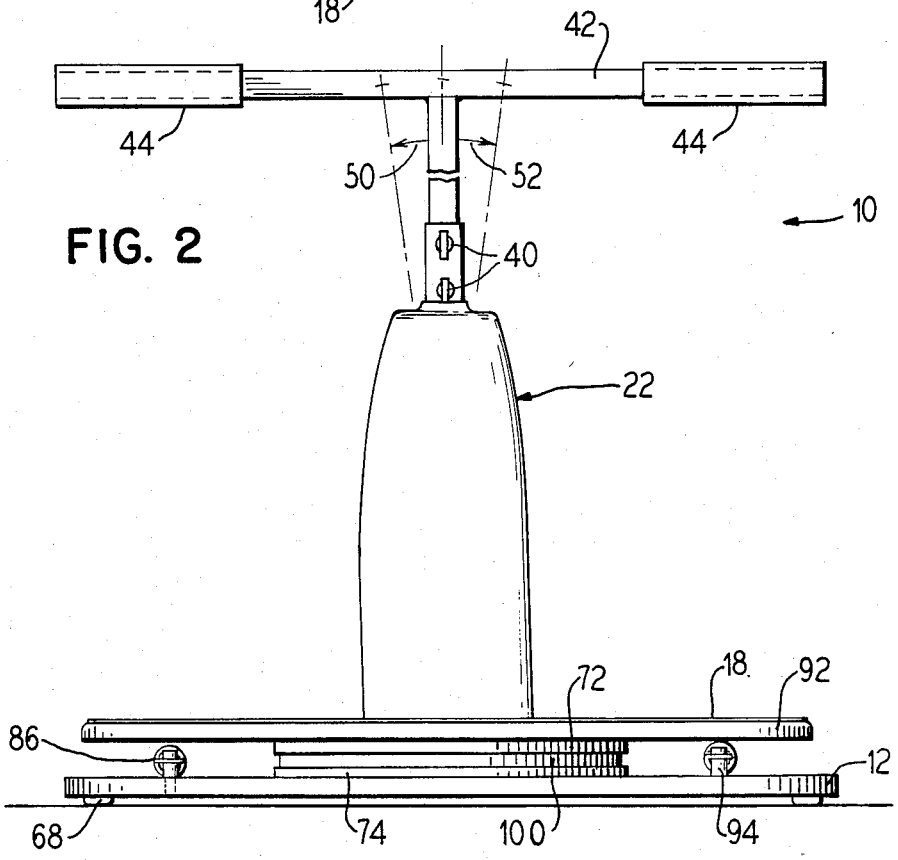
FIG. 2 is an elevation of the exercise device of FIG. 1 as viewed along the line II—II of FIG. 1.

As is readily apparent from FIGS. 1, 2 and 3, particularly from the motion arrows 46, 48, 50, 52, 54 and 56, a user may manipulate the handle 36 and the cross member 42 in three primary directions and, as is also evident, may combine such movements. It is also readily apparent that any movement of the handle is opposed by the spring and that resistive forces are therefore transmitted back through the arms and body of the user to his legs and feet. For added comfort and a better grip, the cross member 42 may be provided with a pair of hand grips 44.

Wall Mounting

The same basic structure discussed above, without the support platform 12 and the mat 18, although the latter may be provided as a separate element, may be adapted for similar manipulations with the base 20 affixed to a wall such that the cross member 42 extends horizontally with respect to the floor and the movements 46–56 are similarly translated in direction.

Fold-Up Structure

From the discussion above it is readily apparent that the pins 40 may be removed to release the handle 36, 42 so that the same may be withdrawn from the tube 26. In addition, the base 20, which was previously discussed as being affixed to the platform 12 (as by carriage bolts or the like), may be hinged to the support 12 by a hinge 58 which is, for example, welded to the base 20 on one side of the hinge and secured by a plurality of bolts 60 on the other side of the hinge. At the opposte end, a pair of wing nuts may be provided, as illustrated in FIGS. 1 and 2, in which each wing nut 62 comprises, for example, a countersunk carriage bolt 64 and a nut 66 for quick release and folding of the spring structure toward the support 12. In this condition, and particularly with the handle 36, 42 removed, the device is rendered more compact for storage.

Personal Adaptability

It is recognized that the exercise device of the present invention may serve a wide range of persons from children up to stronger and more serious body builders. Therefore, the exercise device is readily adaptable to different strengths by providing that the base plate, spring, plate 25 and tube 26 be replaceable with similar structures which have different spring coefficients. This may be done by simply unlatching the wing nuts 62 and removing the bolts 30, if the hinge structure is employed. Otherwise, simple removal of a plurality of carriage bolts or the like accommodates such adaptive replacement.

Moveable Mat Structure

Referring briefly to FIG. 1, the mat 18 is now considered not to be fixed so that the same may pivot in accordance with the motion arrow 70 under the action of a pair of springs 86 which are affixed at their ends as indicated at 88 and 90. It is readily apparent that movement of the handle in the direction 48, for example, will translate into a complementary movement of the mat 18.

Figure 4:
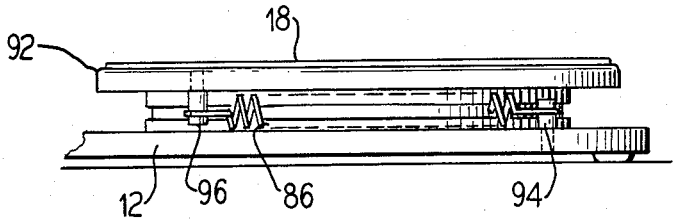
FIG. 4 is a view of a portion of the platform structure as viewed in the direction of the line IV—IV of FIG. 1.

As best seen in FIGS. 3 and 4, the mat 18 is carried on a plate 92 which has a thin metal plate 72 secured thereto, as by screws 76. The platform 12 in this area includes a similar thin metal plate 74 which is attached thereto, as by screws 78. The plate 74 includes an extension 82 which depends into a bore 84 which receives a pivot pin 80 which is connected to or integral with the plate 72. A thin layer of synthetic material 100, such as nylon or Delrin is located between the plates 72 and 74 to reduce friction.

As best seen in FIG. 4, movements of the structure 18, 92 with respect to the support 12 are resisted by at least one spring 86 which has a first end mounted in a groove of a grooved projection 94 extending from the support 12. A similar spring mount is provided at the opposite end at a projection 96 which extends from the plate 92. The projections 94, 96 may advantageously be secured to the respective mounts by screws or the like for ease of assembly and disassembly.

In order to protect a floor and provide friction relative thereto, the exercise device may also be provided with a plurality of feet 68 for all embodiments, including the wall-mounted embodiments where the mat 18 may be supported on a separate plate, similar to the plate 92.

As will be appreciated by those who are practicing fitness programs, such as aerobic dancing and jazzercize, rhythmic sequences of exercise may be performed with the present invention, particularly where the mat 18 is carried on a pivotal plate 92.

As an example of an exercise device which has been built and tested, the following components were used.

| Reference | Material | Dimensions |
|---|---|---|
| 12 | Structure Wood (O.S.B) | 32" × 40" × ¾" |

-continued

| Reference | Material | Dimensions |
|---|---|---|
| 18 | Rubber | 18" × 30" |
| 20 | Steel | 16" × 16" × 3/16" |
| 24 | Steel | 6.5" O.D. × 18" |
| 25 | Steel | 3.5" O.D. × 3/16" |
| 30 | Vinyl | 6.5+" I.D. × 20" |
| 34* | Steel | 6.5" O.D. |
| 26 | Steel | 1¼" × 6", 11 Gauge |
| 36* | Steel | 1" 30", 14 Gauge |
| 42* | Steel | 1" × 32", 14 Gauge |
| 44 | Rubber Grip | 8" |
| 68 | Rubber Grommet | 1¼" × 1¼" |

*May be square, rectangular or round tube.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. An exercise device comprising:

a base means adapted for attachment to a support;

first spring means including a first end connected to said base, said first spring means having a second end;

a handle connected to and extending from said second end of said first spring means;

said first spring means flexing and storing and releasing energy in response to the application by a user to and removal of force from said handle;

a support, said base means attached to said support, said support adapted to rest on a floor and comprising feet of a material to provide friction with respect to a floor, a first section mounting said base, said support including a second section which includes a portion for supporting a person when the person grasps said handle; and second spring means connecting said portion for supporting a person to permit biasing of said portion during bidirectional pivotal movement of said portion.

2. The exercise device of claim 1, wherein said handle comprises:

a first end connected to said second end of said first spring means;

a second end spaced from said first end; and hand grip means carried by said second end of said handle.

3. The exercise device of claim 1, wherein said handle comprises:

a first member including a first end connected to said second end of said first spring means, and a second end;

a second member connected to said second end of said first member forming a T shape; and hand grips carried spaced apart on said second member.

4. The exercise device of claim 3, and further comprising:

at least one pin; and wherein said first member comprises a plurality of first holes therethrough spaced apart adjacent said first end of said first member, and a tube carried by said second end of said first spring means for telescopic mating with said first end of said handle, and including a plurality of second holes spaced with the same spacing of said first holes for selective alignment therewith, said at least one pin being removably received in said aligned first and second holes for selective adjustment of the length of said handle.

5. The exercise device of claim 1, wherein:

said handle comprises a T-shaped structure including a leg having first and second ends, said first end connected to said second end of said first spring means, and a crossbar connected to said second end of said leg.

6. The exercise device of claim 1, wherein: said first spring means comprises a coil spring.

7. An exercise device comprising:

a base means adapted for attachment to a support;

a spring including a first end connected to said base, and said spring having a second end;

a handle connected to and extending from said second end of said spring;

said spring flexing and storing and releasing energy in response to the application by a user and removal of force from said handle;

a support means adapted to rest on a floor, said support means comprising feet of a material to provide friction with respect to the floor;

hinge means hingedly connecting said base to said support means; and releasable locking means for releasably locking said base in a fixed position on said support means.

8. An exercise device comprising:

a base means adapted for attachment to a support;

a spring means including a first end connected to said base, and said spring means being a second end;

a handle connected to and extending from said second end of said spring means;

said spring means flexing and storing energy in response to the application of a bending force to said handle and the release of energy by the spring means when a user removes his force on the handle;

a flexible boot having said spring means and extending from said handle to said base means;

a ring mounted on and extending from said base means; and fastener means for removably connecting said boot to said ring.

* * * * *